US006575247B2

(12) United States Patent
Tolman et al.

(10) Patent No.: US 6,575,247 B2
(45) Date of Patent: Jun. 10, 2003

(54) DEVICE AND METHOD FOR INJECTING FLUIDS INTO A WELLBORE

(75) Inventors: Randy C. Tolman, Spring, TX (US); Curtis Kofoed, The Woodlands, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 0 days.

(21) Appl. No.: 10/192,032

(22) Filed: Jul. 10, 2002

(65) Prior Publication Data

US 2003/0010498 A1 Jan. 16, 2003

Related U.S. Application Data

(60) Provisional application No. 60/305,220, filed on Jul. 13, 2001.

(51) Int. Cl.[7] ..... E21B 37/06
(52) U.S. Cl. ..... 166/305.1; 166/75.15
(58) Field of Search ..... 166/305.1, 307, 166/308, 306, 90.1, 75.15

(56) References Cited

U.S. PATENT DOCUMENTS

| | | | | |
|---|---|---|---|---|
| 4,076,079 A | | 2/1978 | Herricks et al. | 166/308 |
| 4,169,504 A | | 10/1979 | Scott | 166/90 |
| 4,292,947 A | * | 10/1981 | Tanasawa et al. | 123/445 |
| 4,832,128 A | | 5/1989 | Light et al. | 166/377 |
| 4,848,480 A | | 7/1989 | Titchener et al. | 166/385 |
| 5,012,865 A | | 5/1991 | McLeod | 166/90 |
| 6,364,024 B1 | * | 4/2002 | Dallas | 166/379 |
| 6,394,184 B2 | | 5/2002 | Tolman et al. | 166/281 |

FOREIGN PATENT DOCUMENTS

WO WO 02/06629 1/2002

* cited by examiner

*Primary Examiner*—William Neuder
(74) *Attorney, Agent, or Firm*—Gary P. Katz

(57) ABSTRACT

A device and method for delivering fracture fluid (e.g., erosive materials) into an oilfield wellbore while the well has wireline, coiled tubing, jointed tubing or any other apparatus encumbering the flow path of the erosive fluid that is being injected into the device. The device provides the ability to insert and remove equipment in the wellbore during fluid treatment while maintaining access to the full wellbore diameter. The invention also provides a method for delivery and positive, down-hole displacement of material (i.e., diverting material including, but not limited to buoyant ball sealers).

17 Claims, 7 Drawing Sheets

DEVICE AND METHOD FOR INJECTING FLUIDS INTO A WELLBORE

RELATED U.S. APPLICATION DATA

This application claims the benefit of U.S. Provisional Application No. 60/305,220, filed Jul. 13, 2001.

FIELD OF THE INVENTION

This invention relates generally to the field of treating subterranean formations to increase the production of oil and/or gas therefrom. More specifically, the invention pertains to a device and method for injecting fluids into an oilfield wellbore.

BACKGROUND OF THE INVENTION

When a hydrocarbon-bearing, subterranean reservoir formation does not have enough permeability or flow capacity for the hydrocarbons to flow to the surface in economic quantities or at optimum rates, hydraulic fracturing or chemical (usually acid) stimulation is often used to increase the flow capacity. A wellbore penetrating a subterranean formation typically consists of a metal pipe (casing) cemented into the original drill hole. Lateral holes (perforations) are shot through the casing and the cement sheath surrounding the casing to allow hydrocarbon flow into the wellbore and, if necessary, to allow treatment fluids to flow from the wellbore into the formation.

Hydraulic fracturing is a routine procedure in petroleum industry operations as applied to individual target zones of up to about 60 meters (200 feet) of gross, vertical thickness of subterranean formation. When there are multiple or layered reservoirs to be hydraulically fractured, or a very thick hydrocarbon-bearing formation (over about 60 meters), then alternate treatment techniques are required to obtain treatment of the entire target zone. Methods for improving treatment coverage are commonly known as "diversion" methods in petroleum industry terminology.

New techniques to improve diversion and treatment effectiveness for hydraulic fracturing or acid stimulating are described in U.S. patent application Ser. No. 09/891,673, and U.S. Pat. No. 6,394,184. These techniques require wireline, slickline, coiled tubing or jointed pipe to penetrate the wellhead during treatment operations and thus to intersect the injection path of the stimulation fluid entering the wellhead. Currently, protection devices with short stubs of pipe or blast joints are used to shield the wireline or tubing (coiled tubing or jointed tubing) from direct impingement of the stimulation fluids. Using short stubs of pipe or blast joints does not allow full wellbore diameter access for running tools, mechanical plug setting, or logging with large diameter tools. Also, use of short stubs of pipe results in additional expenses and operational delays in rigging down and rigging up flanged/threaded connections to clear the wellhead path for tool work requiring full-bore access.

When wireline or tubing lubricators, or any other type of equipment, is connected to the top of the wellhead, a stagnant pocket of fluid or air is created above the entry point(s) of the stimulation fluid. Diverting and other materials injected into the wellbore during the stimulation treatment, including, but not limited to buoyant ball sealers, may become trapped in this stagnant pocket, and thus compromise the success of the stimulation treatment.

No commercially-available injection devices protect wireline, slickline, coiled tubing, jointed pipe or other encumbering equipment in the wellhead while also permitting abrasive stimulation fluid, to be pumped into the wellhead and providing full-casing bore access. Nor do these commercially available injection devices ensure positive, down-hole displacement of diverting material.

U.S. Pat. No. 4,169,504 (Scott) describes a wellhead device to protect production tubing during abrasive fluid injection using downward and tangential fluid entry into the annulus formed between the casing and production tubing. This device has multi-port injection capability but was intended to protect production tubing only, and hence did not provide for full-diameter casing bore access for stimulation work such as logging, bailer runs, bridge plugs, etc. since the permanently installed production tubing was designed to remain in the wellbore. Furthermore, Scott provides no apparatus or method to insert and remove equipment in and out of the wellbore during fluid treatment.

U.S. Pat. No. 4,076,079 (Herricks, et al.) describes a method and apparatus for fracture treating while maintaining full-diameter casing bore access for running packers and perforating guns before and after the fracture treatment. However, the device and method do not have wireline, slickline, coiled tubing, jointed tubing, or any other stimulation equipment suspended in the wellbore during a fracture treatment, and thus, provide no means to protect the wireline, slickline, coiled tubing, jointed tubing, or other stimulation equipment from abrasive stimulation fluid.

Accordingly, there is a need for a fluid injection device that provides full bore access to the wellbore while protecting any apparatus suspended in the wellbore during fluid treatment. The fluid injection device should also provide means to ensure positive, down-hole displacement of buoyant material.

SUMMARY OF THE INVENTION

This invention provides a fluid injection device for use in introducing fluid into a wellbore. The device comprises a main housing having a main central bore extending longitudinally therethrough and being aligned with the longitudinal axis of the wellbore, the main central bore having a diameter at least equal to the inside diameter of the wellbore, thereby allowing wellbore equipment full access to the wellbore; and at least one side fluid inlet bore extending tangentially into the main central bore at a downwardly inclined angle to the longitudinal axis of the wellbore, whereby treatment fluid injected into the wellbore from the side fluid inlet bore will travel in a downward spiral flow pattern thereby reducing impingement of the treatment fluid upon any wellbore equipment positioned in the wellbore.

This invention further provides a method of injecting fluid into a wellbore. The method comprises (a) providing a fluid injection device with a main housing having a main central bore extending longitudinally therethrough and being aligned with the longitudinal axis of said wellbore, the main central bore having a diameter at least equal to the inside diameter of the wellbore, thereby allowing wellbore equipment full access to said wellbore; (b) providing at least one side fluid inlet bore extending tangentially into the main central bore at a downwardly inclined angle to the longitudinal axis of the wellbore, whereby fluid injected into the wellbore from the side fluid inlet bore will travel in a downward spiral flow pattern; and (c) directing fluid injected from the side fluid inlet to enter the main central bore and travel in a downward spiral flow pattern thereby reducing impingement of the injected fluid upon any device positioned in the wellbore.

BRIEF DESCRIPTION OF THE DRAWINGS

The present invention and its advantages will be better understood by referring to the following detailed description and the attached drawings in which.

DETAILED DESCRIPTION OF THE INVENTION

Figure 1A:
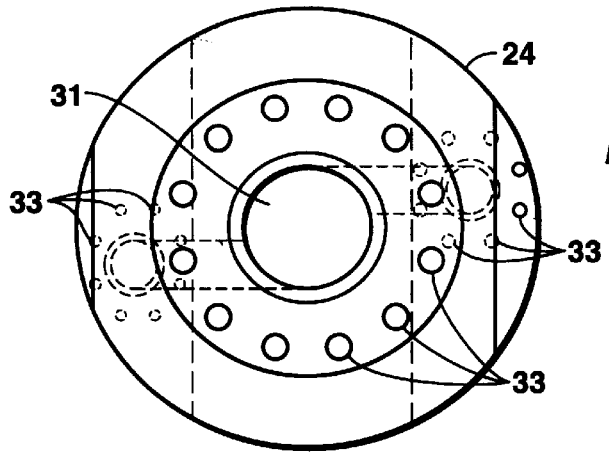
FIGS. 1A–1G illustrates a first embodiment of the invention made from a bar stock of steel.
Figure 1B:
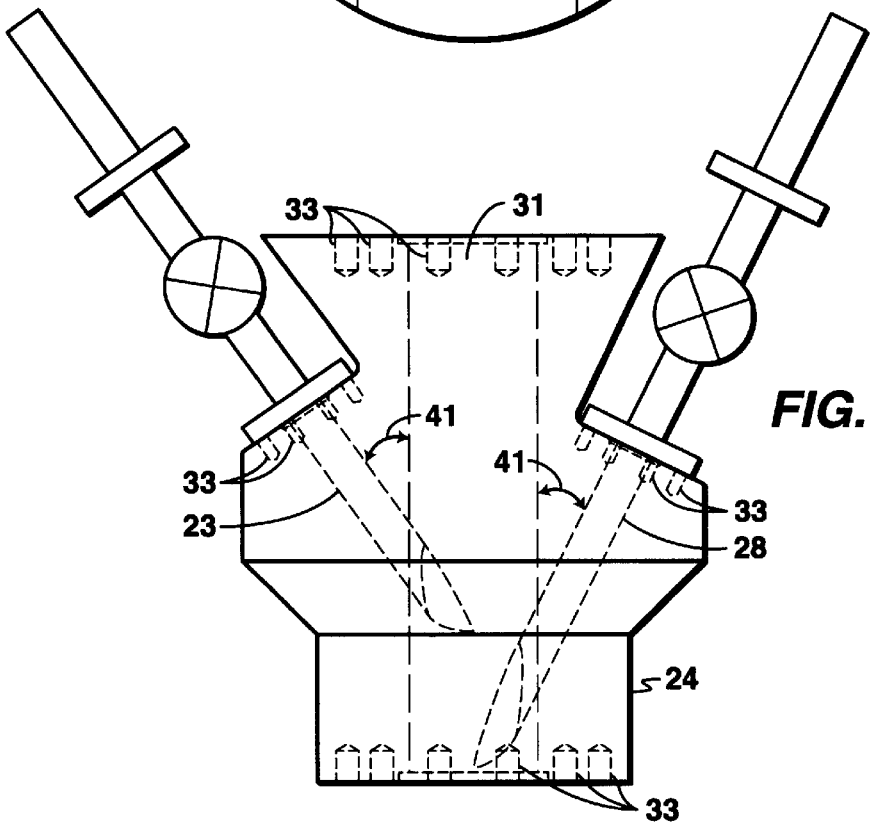
Figure 1C:
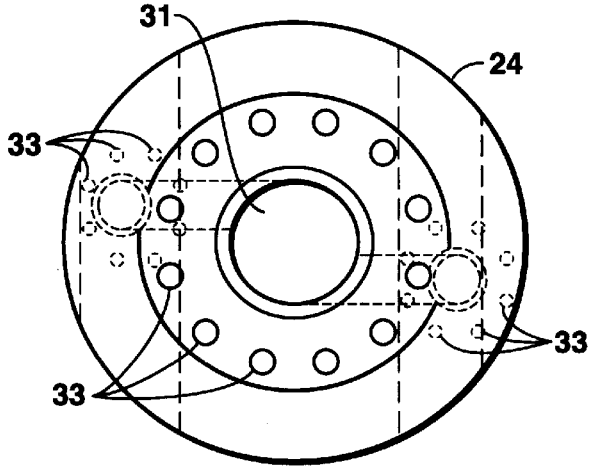
Figure 1D:
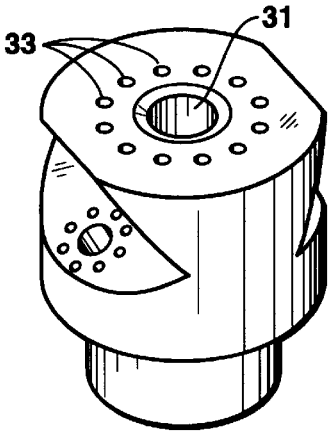
Figure 1E:
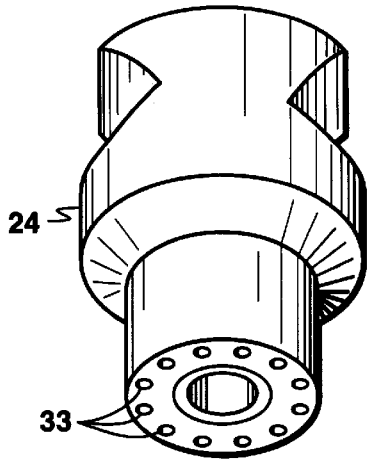
Figure 1F:
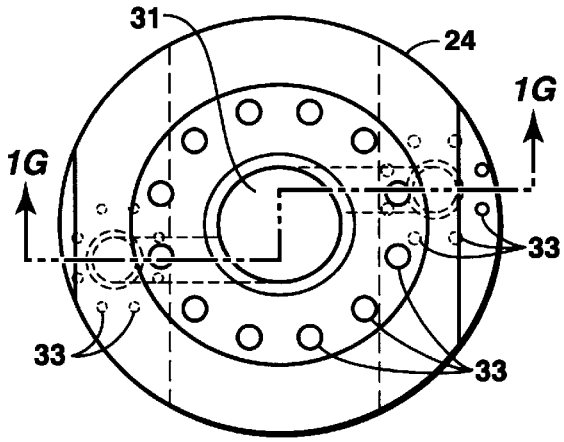
Figure 1G:
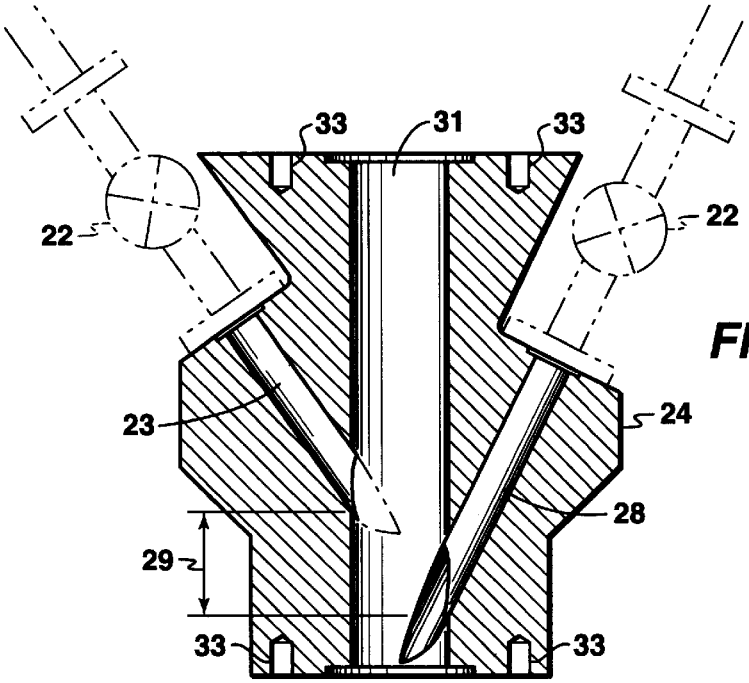
Figure 2A:
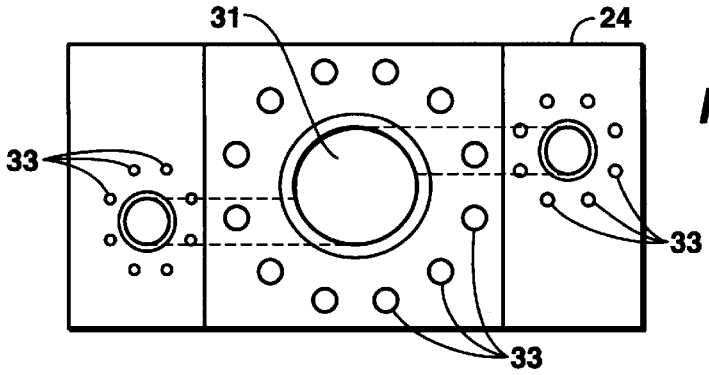
FIGS. 2A–2F illustrates a second embodiment of the invention made from a billet of steel.
Figure 2B:
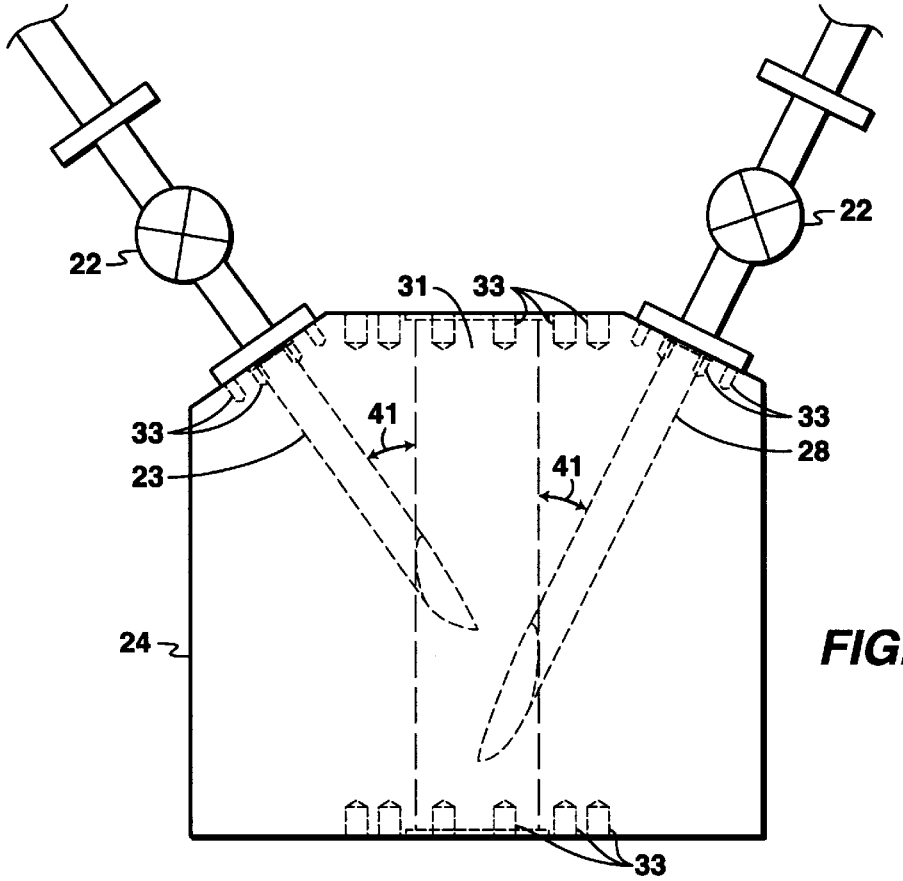
Figure 2C:
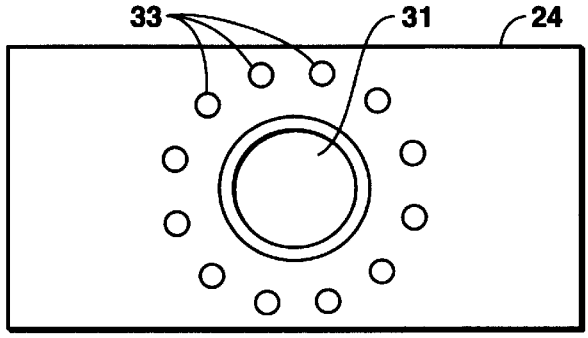
Figure 2E:
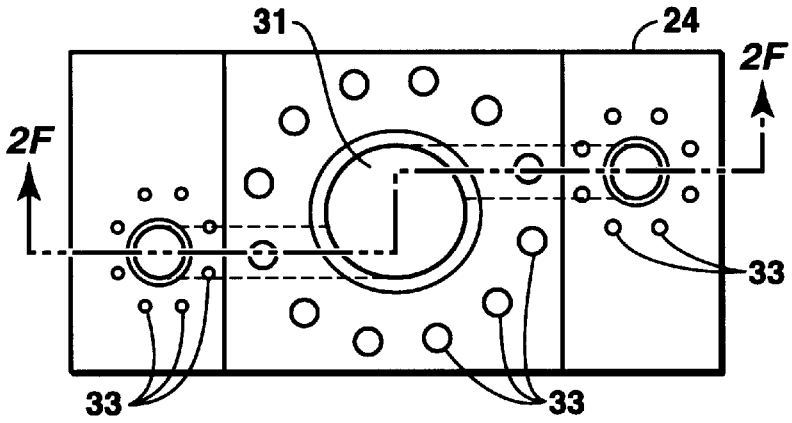
Figure 2F:
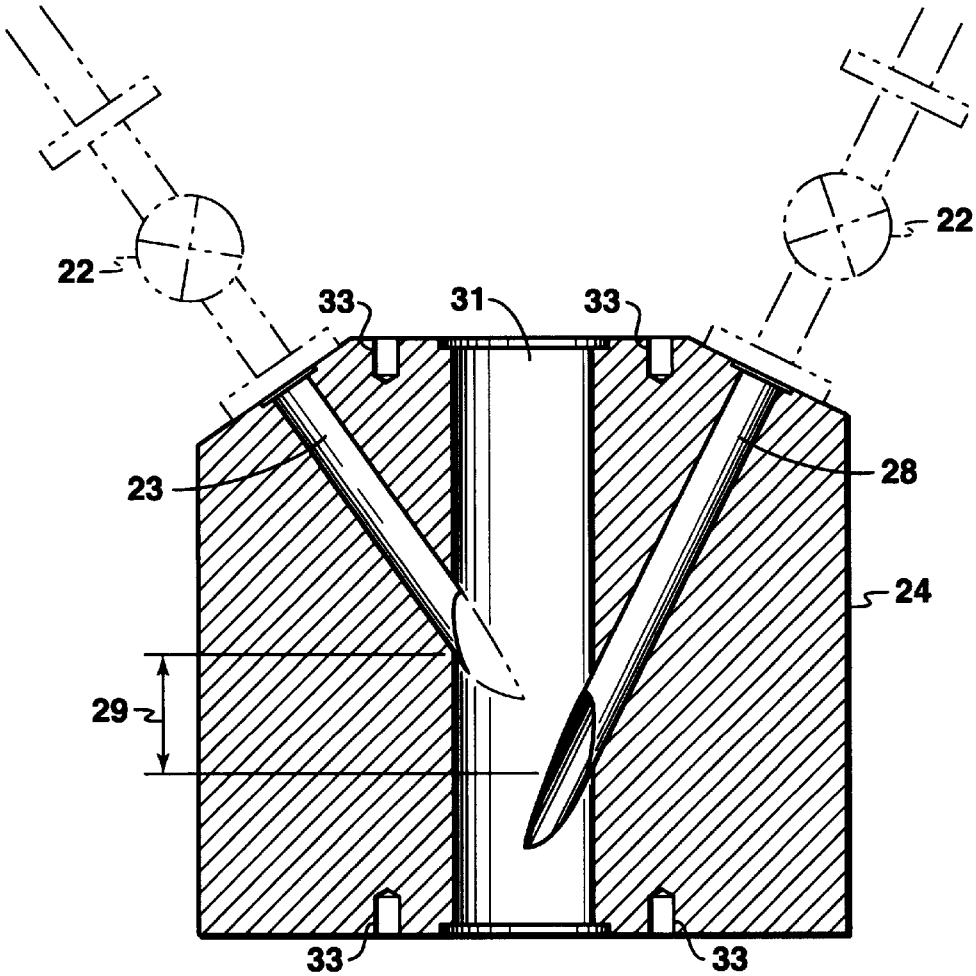
Figure 2D:
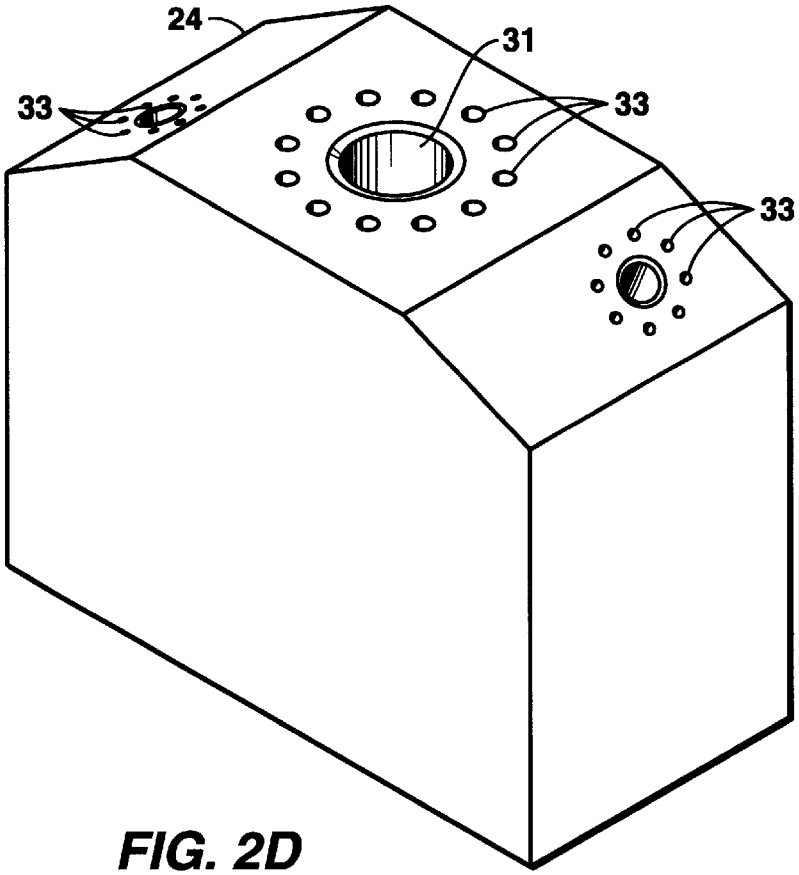

The present invention will be described in connection with its preferred embodiments. However, to the extent that the following description is specific to a particular embodiment or a particular use of the invention, this is intended to be illustrative only, and is not to be construed as limiting the scope of the invention. On the contrary, it is intended to cover all alternatives, modifications, and equivalents that are included within the spirit and scope of the invention, as defined by the appended claims.

The current invention provides a means for full-diameter casing bore access while also protecting an apparatus that is suspended in the wellhead (i.e., wireline, slickline, coiled tubing, or jointed tubing) from damaging fluid impingement during stimulation treatments. The current invention also provides a means for ensuring down-hole delivery of diverter material while providing full-diameter casing bore access and protection of suspended items in the wellhead.

One embodiment of the invention is a wellhead device with a main central bore aligned with the wellbore axis with an inside diameter that is greater than or equal to the wellbore inside diameter. As used herein, the "wellbore inside diameter" means the inside diameter of the well casing in which the stimulation operations are occurring. The inside diameter of the main bore of the device is such that there is no restriction on the diameter of tools that can pass through the main bore and still fit inside the wellbore. As further described below, there are one or more fluid entry points into the main bore that have a diameter smaller than the main bore and are directed downwardly and tangentially with respect to the main bore axis such that the injected fluid enters the wellhead in a downward spiral flow pattern. This spiral flow pattern reduces the velocity of the fluid towards the centerline of the main bore, thus reducing the damage potential due to direct impingement of injected fluids on wireline, slickline, coiled tubing, jointed tubing, or other apparatus suspended in the wellhead during treatment.

In a preferred embodiment, there are two or more fluid entry ports and one or more of the fluid entry ports are positioned higher on the main bore than the remaining fluid entry ports. The diverter or other materials (i.e., buoyant materials) are injected into the wellhead through the lower fluid entry ports. The fluid entering through the upper fluid entry ports creates a net downward fluid flow which forces the injected material to be transported down through the wellhead and into the casing, thus preventing any injected material from becoming trapped in the stagnant pocket of fluid that exists above the fluid entry ports. Also, the main bore diameter of the wellhead device is sized such that the downward fluid velocity is large enough to overcome the upward buoyant force of any injected materials (i.e., buoyant ball sealers).

The invention can be manufactured from a bar stock (FIGS. 1A–1G) or billet of steel (FIGS. 2A–2F) suitable for oilfield service. Service requirements are governed by American Petroleum Institute (API) specifications. Steel thickness and properties are governed by desired service pressures, temperatures, and contacting fluids. Material specifications are flexible, depending on specific well environment. Manufacturing techniques are not limited to billet or bar steel as there are other acceptable techniques known in the art (e.g., welded pipe members).

Referring to FIGS. 1A–1G or FIGS. 2A–2F the center bore 31 is equal to, or greater than, the inside diameter of the wellbore. This large center bore 31 will allow for full wellbore access to run oilfield tools and equipment without incurring the expense and operational delays of removing the invention. This large center bore 31 will also rapidly dissipate the fluid velocity of the incoming stimulation fluid, thus reducing erosional effects on encumbering equipment.

The invention is designed to be installed as part of the wellhead. The invention design incorporates the typical API flange or studded connection 33 for well work, although other means of connection to the inlet and outlet ports are known in the art. The bottom central bore outlet is nippled up or connected to the wellhead, generally above the master valve. The top of the central bore 31 is nippled up or connected to the wireline or coiled tubing lubricator, or any other necessary well field equipment such as a valve or a blow out preventer.

Figure 3:
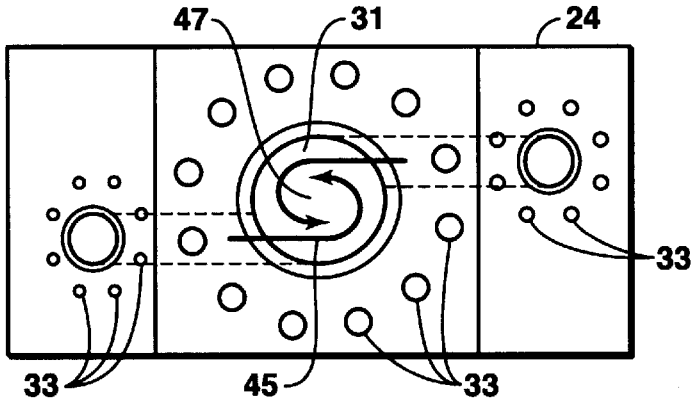
FIG. 3 is an illustration of a downward helical fluid flow in the wellbore.

The invention includes a housing 24 with a center bore 31 and one or more side fluid inlet bores 23 and 28 in the housing 24 for the injection of stimulation fluid into the center bore 31. The inside diameters of the side fluid inlet bores 23 and 28 are less than the inside diameter of the center bore 31. The side fluid inlet bores 23 and 28 are angled downwardly with respect to the center bore 31 and preferably enter the inside of the center bore 31 tangent to the outer diameter (or the internal diameter of the casing) of the center bore 31 (as shown in FIG. 3). Preferably, the injected fluid will travel in a circular, helical flow inside the center bore 31 (as shown in FIG. 3). The helical flow is symmetrical to the outer diameter of the center bore 31. By having the side fluid inlet bores 23 and 28 enter the center bore 31 tangent to (or at one point on the circle of) the outer diameter of the center bore 31, the fluid entering through the side fluid inlet bores 23 and 28 will enter tangentially to create the preferred helical flow inside the wellbore.

The fluid entering the wellbore may possess three unique components to the fluid velocity vector as defined by an orthogonal coordinate system. For a circular pipe flow geometry, these three unique velocity components may be referred to as the normal velocity component, the tangential velocity component, and the longitudinal velocity component. The longitudinal velocity component is understood to be aligned with the longitudinal-axis of the pipe; the normal velocity component is understood to be aligned with the normal-axis (which is in the direction both identically perpendicular to the circular wall of the pipe and perpendicular to the longitudinal-axis); and the tangential velocity component is understood to be aligned with the tangential-axis (which is both identically perpendicular to the normal-axis and perpendicular to the longitudinal-axis). As used herein, "tangential" or "tangentially" only requires a tangent component of the fluid flow entering the wellbore.

The side fluid inlet bores 23 and 28 are angled downward 41 into the center bore 31 to reduce the horizontal velocity component of the stimulation fluid impinging on the wireline, slickline, coiled tubing, jointed pipe, or other equipment suspended in the wellhead. A smaller horizontal velocity of the stimulation fluid reduces the erosional force applied to the wireline, slickline, coiled tubing, or jointed pipe. The side fluid inlet bores 23 and 28 enter the center bore 31 tangent to its inside diameter to reduce direct impingement of stimulation fluids on the equipment suspended in the wellbore.

FIG. 3 illustrates the vortex or downward helical flow 45 into the wellbore 31. Since the side fluid inlet bores 23 and 28 have a smaller inside diameter than the center bore inside diameter, the tangential entry of the fluid leaves a "dead space" 47 in the middle of the center bore 31. The "dead space" 47 in the center bore 31 of the invention is where the stimulation fluid will not impinge on the wireline, slickline, coiled tubing, jointed pipe, or other wellbore device. Instead of impinging on the wireline, coiled tubing, jointed pipe, or other wellbore device, the stimulation fluid impinges on the wall of the center bore 31. The tangential entries of the fluid from the side fluid inlet bores 23 and 28 are such that they compliment each other and create a vortex in the center bore 31. This fluid vortex acts to hydraulically center the wireline, coiled tubing, or jointed pipe into the "dead space" 47, further protecting the equipment. The "dead space" can be increased for larger diameter equipment, by increasing the diameter of the center bore or by reducing the diameter of the side inlet bore(s). The side inlet bore(s) are smaller internal diameter (ID) than the radius of the center bore, therefore, there is a cylinder of "dead space" through the center bore substantially protected against impingement of injected erosive fluid. The diameter of this protected cylinder space can be increased by increasing the diameter of the center bore or by reducing the diameter of the side inlet bore(s).

Adjusting the downward angle 41 (see e.g., FIGS. 1B and 2B) of the side fluid inlet bores 23 and 28 modifies the horizontal velocity of the fluid flow and geometry of the vortex. Furthermore, adjusting the orientation and number of side fluid inlet bores 23 and 28 permits greater control over the size and desired helical flow 45 geometry in the wellbore. Therefore, one skilled in the art of fluid mechanics can control velocity direction and the geometry of the helical flow 45 by manipulating the internal diameter, quantity (number of inlets), orientation and downward angles of the side fluid inlet bores 23 and 28. Factors in determining favorable flow patterns include the fluid flow rate, type of fluid, how resistant the equipment is to erosion from the fluid, size of the equipment encumbering the well in relation to the total wellbore diameter, and amount of time equipment is needed in the wellbore.

The vertical entry points of the side fluid inlet bores into the center bore can be staggered. One side inlet (e.g., inlet 23 in FIG. 1B) enters higher than the entry point of the other side inlet (e.g., inlet 28 in FIG. 1B). The purpose of this design is to provide positive, down-hole displacement of the diversion material, (e.g., ball sealers). The diversion material is pumped into the well head fluid injection device and wellbore through the bottom side fluid inlet bore. The positive, down-hole movement of the stimulation fluid from the top side fluid inlet bore displaces the diverting material down-hole. This is particularly significant for buoyant ball sealers, which can float in the stagnant pocket of fluid above the well head fluid injection device. While the staggered side fluid inlet bores were developed for wellbore diverting materials, the design can provide positive, down-hole movement for all materials injected into the wellbore. Furthermore, varying the longitudinal distance 29 (FIGS. 1G and 2F) between the side inlet ports reduces exposure to erosive fluid flows at any given location on equipment in the wellbore (i.e., wireline, tubing, etc.). The "higher and lower" entry points do not allow potential erosion to occur at the same longitudinal location from 2 or more sides, thus reducing the risk of failure of any component deployed during pumping operations.

The invention becomes an integral part of the wellhead during completions and workovers. It does not need to be removed during completions or workovers. Side inlet control valves 22 may be bolted to the invention as well as master and crown valves, below and above, as needed for well control. The invention could also incorporate valves machined into the body of the invention. This would reduce the total weight of the wellhead, decrease rig-up time, lower costs, and increase efficiencies in executing well work.

The invention has direct application in stimulation technologies as described in U.S. Pat. No. 6,394,184 and U.S. patent application Ser. No. 09/891,673. Both are methods of hydraulic or acid stimulation of multiple hydrocarbon-bearing zones that employ mechanical equipment, which encumbers the wellhead while injecting abrasive stimulation fluid. The methods also involve pumping diverting agents into the wellhead with the stimulation fluid. In addition, they require full wellbore access for running in hole with equipment, such as bailers, bridge plugs, and logging tools.

The following description will be based on hydraulic fracturing using a treating fluid comprising a slurry of proppant materials with a carrier fluid. However, the present invention is equally applicable to any other oilfield operation that may include injecting or removing fluid or injecting or removing diverting material from a wellbore regardless of any simultaneously suspended hardware in the wellbore.

Figure 4:
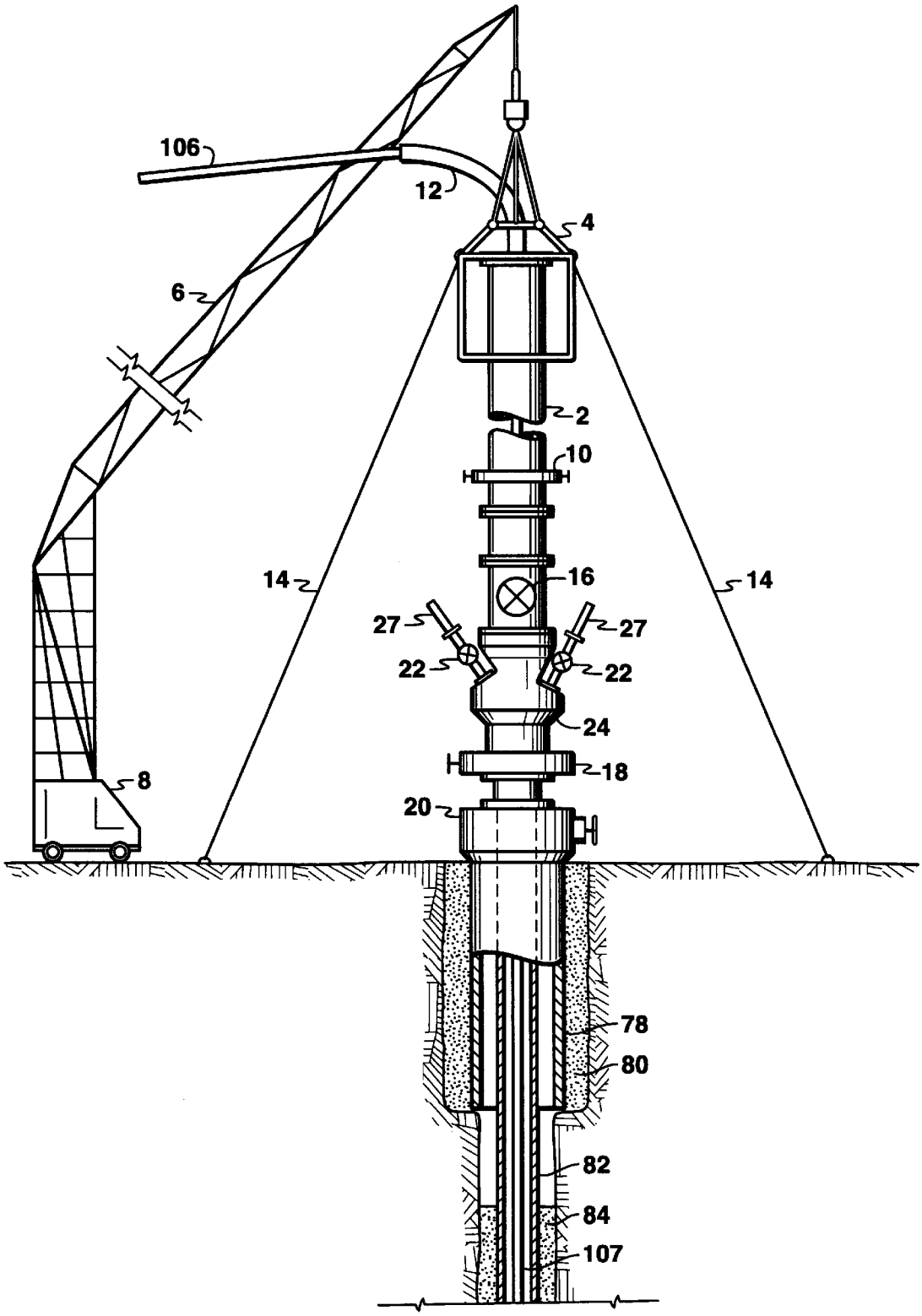
FIG. 4 is a schematic of a representative wellbore configuration showing the invention being utilized during a coiled tubing stimulation operation with abrasive fluid being pumped down the annulus.

Referring now to FIG. 4, an example of the type of surface equipment that typically would be utilized in a multi-stage fracturing treatment as described in U.S. patent application Ser. No. 09/781,597 would be a rig up that used a very long lubricator 2 with the coiled tubing injector head 4 suspended high in the air by crane arm 6 attached to crane base 8. Depending on the overall length requirements and as determined prudent based on engineering design calculations for a specific application, to provide for stability of the coiled tubing injection head 4 and lubricator 2, guy-wires 14 could be attached at various locations on the coiled tubing injection head 4 and lubricator 2. The guy wires 14 would be firmly anchored to the ground to prevent undue motion of the coiled tubing injection head 4 and lubricator 2 such that the integrity of the surface components to hold pressure would not be compromised. Depending on the overall length requirements, alternative injection head/lubricator system suspension systems (coiled tubing rigs or fit-for-purpose completion/workover rigs) could also be used.

The wellbore would typically comprise a length of a surface casing 78 partially or wholly within a cement sheath 80 and a production casing 82 partially or wholly within a cement sheath 84 where the interior wall of the wellbore is composed of the production casing 82. Coiled tubing 106 is inserted into the wellbore using the coiled tubing injection head 4 and lubricator 2. Also installed to the lubricator 2 are blowout preventers 10 that could be remotely actuated in the event of operational upsets. The crane base 8, crane arm 6, coiled tubing injection head 4, lubricator 2, and blowout preventers 10 (and their associated ancillary control and/or actuation components) are standard equipment components well-known to those skilled in the art that will accommodate methods and procedures for safely installing a coiled tubing bottomhole assembly in a well under pressure, and subsequently removing the coiled tubing bottomhole assembly from a well under pressure.

Also shown in FIG. 4 are several different wellhead spool pieces that may be used for flow control and hydraulic isolation during rig-up operations, stimulation operations, and rig-down operations. The crown valve 16 provides a device for isolating the portion of the wellbore above the crown valve 16 from the portion of the wellbore below the crown valve 16. The upper master fracture valve 18 and lower master fracture valve 20 also provide valve systems for isolation of wellbore pressures above and below their respective locations. Depending on site-specific practices and stimulation job design, it is possible that not all of these isolation-type valves may actually be required or used.

The side inlet injection valves 22, shown in FIG. 4, provide a location for injection of stimulation fluids through the housing 24 and into the wellbore. The piping 27 from the surface pumps and tanks used for injection of the stimulation fluids would be attached with appropriate fittings and/or couplings to the side inlet injection valves 22. The stimulation fluids would then be pumped into the wellbore via this flow path. With installation of other appropriate flow control equipment, fluid may also be produced from the wellbore using the housing 24 and the side inlet injection valves 22.

The treatments as described in U.S. patent application Ser. No. 09/781,597 have multiple stages of fracturing performed with a bottomhole assembly to provide alternating means of perforating and positive zonal isolation between fracture stages. The bottomhole assembly remains suspended in the well during the treatment and is suspended by means of cable, wireline, electric line, coiled tubing 106 or jointed tubing hanging through the wellhead and into the wellbore. The fracture treatments include a solids-laden slurry pumped at a high rate into the side inlet injection valves 22 and into the wellhead fluid injection device housing 24 while the bottomhole assembly is suspended in the well. The design of the wellhead fluid injection device housing 24 protects any wireline, electric line, slickline, coiled tubing, jointed tubing or other devices encumbering the wellhead from the erosive forces of the solids-laden slurry.

Following the multiple-zone stimulation treatment, the bottomhole assembly can easily be removed from the well without removing the wellhead fluid injection device 24. Other completion items can be inserted into or removed from the well (i.e., bridge plugs, logging tools, fishing tools, bailers, and any large diameter equipment) through the full diameter access provided by the wellhead fluid injection device 24. The full diameter access of the wellhead fluid injection device 24 saves substantial time and expense since bridge plugs and other tools that are necessary to the treatment success can be run through the wellhead fluid injection device 24 without a lengthy procedure for removing and replacing the wellhead fluid injection device 24.

Figure 5:
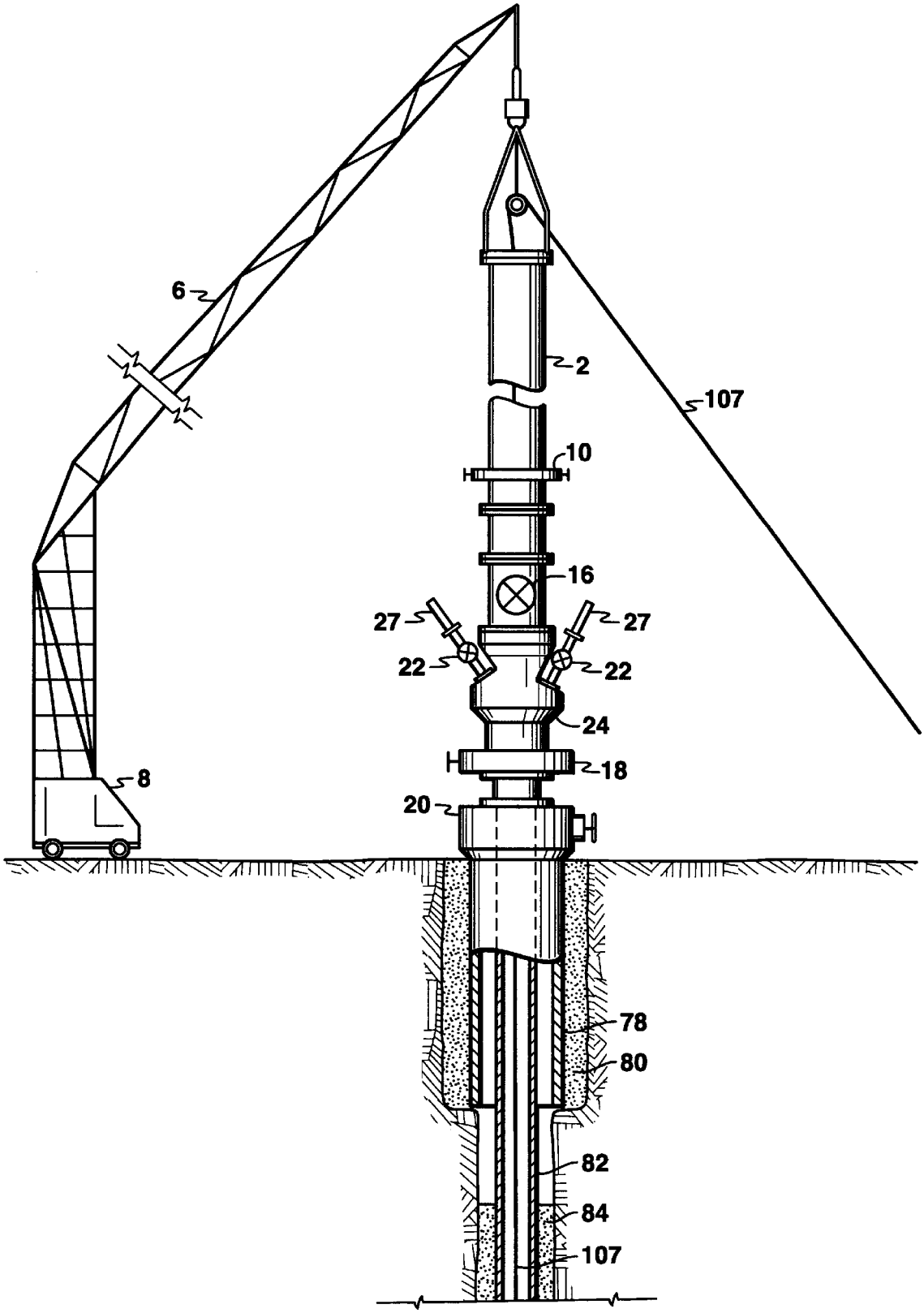
FIG. 5 is an illustration of a representative wellbore configuration showing the invention being utilized during a wireline or slickline stimulation operation.

FIG. 5 illustrates an example of the type of surface equipment that typically would be utilized in a multi-stage stimulation treatment as described in U.S. patent application Ser. No. 09/891,673. The surface equipment would include a very long lubricator 2 suspended high in the air by crane arm 6 attached to crane base 8. The wellbore would typically comprise a length of a surface casing 78 partially or wholly within a cement sheath 80 and a production casing 82 partially or wholly within a cement sheath 84 where the interior wall of the wellbore is composed of the production casing 82. The depth of the wellbore would preferably extend some distance below the lowest interval to be stimulated to accommodate the length of the perforating gun assembly that would be attached to the end of the wireline 107. Wireline 107 is inserted into the wellbore through the lubricator 2. Also connected to the lubricator 2 are blowout preventers 10 that could be remotely actuated in the event of operational upsets. The crane base 8, crane arm 6, lubricator 2, blowout preventers 10 (and their associated ancillary control and/or actuation components) are standard equipment components well known to those skilled in the art that will accommodate methods and procedures for safely installing a wireline perforating gun assembly in a well under pressure, and subsequently removing the wireline perforating gun assembly from a well under pressure.

Also shown in FIG. 5 are several different wellhead spool pieces which may be used for flow control and hydraulic isolation during rig-up operations, stimulation operations, and rig-down operations. The crown valve 16 provides a device for isolating the portion of the wellbore above the crown valve 16 from the portion of the wellbore below the crown valve 16. The upper master fracture valve 18 and lower master fracture valve 20 also provide valve systems for isolation of wellbore pressures above and below their respective locations. Depending on site-specific practices and stimulation job design, it is possible that not all of these isolation-type valves may actually be required or used.

The side inlet injection valves 22 shown in FIG. 5 provide a location for injection of stimulation fluids into the wellbore. The piping 27 from the surface pumps and tanks used for injection of the stimulation fluids would be attached with appropriate fittings and/or couplings to the side inlet injection valves 22. The stimulation fluids would then be pumped into the wellbore via this flow path. With installation of other appropriate flow control equipment, fluid may also be produced from the wellbore using the side inlet injection valves 22.

One embodiment of the stimulation treatment method described in U.S. patent application Ser. No. 09/891,673 involves perforating at least one interval of one or more subterranean formations penetrated by a given wellbore, pumping the desired treatment fluid without removing the perforating device from the wellbore, deploying some diversion agent in the wellbore to block further fluid flow into the treated perforations, and then repeating the process for at least one more interval of subterranean formation.

The ball sealers or other diversion agents would be injected into the wellbore through the side inlet injection valves 22 and then into the wellhead fluid injection device housing 24. Preferably, there would be at least two side inlets, one lower than the other. The diverting material would preferably be injected into the lower of the side fluid inlet bores in the wellhead fluid injection device housing 24 while the remaining treatment fluid is injected into the higher side fluid inlet bores 23 in order to displace the diverting material down the wellbore and to prevent any diverting material (i.e, buoyant ball sealers) from entrapment in a stagnant region above the wellhead fluid injection device housing 24.

The perforating gun assembly remains suspended in the wellbore during the treatment and is suspended by means of cable, wireline 107, electric line, coiled tubing or jointed tubing. The hydraulic fracture treatment includes pumping a solids laden slurry pumped at a high rate into the side inlet injection valves 22 and into the wellhead fluid injection device housing 24 while the perforating gun assembly is suspended in the wellbore. The design of the wellhead fluid injection device housing 24 protects any wireline 107, electric line, slickline, coiled tubing or jointed tubing from the erosive forces of the solids-laden slurry.

Following the multiple-zone stimulation treatment, the perforating gun assembly can easily be removed from the well without removing the wellhead fluid injection device housing 24. Other completion items can be inserted into the well (i.e., bridge plugs, logging tools, fishing tools, bailers, and any large diameter equipment) in the full diameter access provided by the wellhead fluid injection device housing 24. Furthermore, devices can be inserted into and removed from the wellbore through the wellhead fluid injection device during fluid treatment of the wellbore. The full-bore access of the wellhead fluid injection device housing 24 saves substantial time and expense since bridge plugs and other tools that are necessary to the overall treatment success can be run through the wellhead fluid injection device housing 24 without a lengthy procedure for removing the wellhead fluid injection device housing 24. The full-bore access of the wellhead fluid injection device housing 24 provides the operational advantage of lowering costs, speeding up overall job operations and increasing safety by eliminating rigging up and down the wellhead spool pieces during the entire completion procedure. The full-diameter casing bore access of wellhead fluid injection device housing 24 also allows for safer deployment of mechanical decentralizers on the perforating gun. With full-diameter casing access there is less operational concern for catching or having the mechanical decentralizers trapped inside the center bore 31 of the wellhead fluid injection device housing 24. The use of mechanical decentralizers permits more positive positioning of the perforating gun during the stimulation treatments.

Although the embodiments discussed above are primarily related to the beneficial effects of the inventive process when applied to wellbore fluid fracture treatment, this should not be interpreted to limit the claimed invention, which is applicable to any situation in which fluid is injected into the well. Those skilled in the art will recognize that many applications not specifically mentioned in the examples will be equivalent in function for the purposes of this invention.

What is claimed is:

1. A wellbore fluid injection device for use in introducing fluid into a wellbore, said wellbore fluid injection device comprising:

a main housing having a main central bore extending longitudinally therethrough and being aligned with the longitudinal axis of said wellbore, said main central bore having a diameter at least equal to the inside diameter of said wellbore, thereby allowing wellbore equipment full access to said wellbore; and at least one side fluid inlet bore extending tangentially into said main central bore at a downwardly inclined angle to the longitudinal axis of said wellbore, whereby treatment fluid injected into said wellbore from said side fluid inlet bore will travel in a downward spiral flow pattern thereby reducing impingement of said treatment fluid upon any wellbore equipment positioned in said wellbore.

2. The apparatus of claim 1 wherein the internal diameter, quantity, orientation and downward angles of at least one said side fluid inlet bore is chosen to obtain a favorable downward spiral flow pattern.

3. The apparatus of claim 1 wherein the internal diameter, quantity, orientation, and downward angles of at least one said side fluid inlet bore is chosen to obtain a favorable horizontal fluid velocity.

4. The apparatus of claim 1 wherein said housing is manufactured from billet steel.

5. The apparatus of claim 1 wherein said housing is manufactured from bar stock steel.

6. The apparatus of claim 1 wherein said wellhead fluid injection device has at least two fluid inlet bores.

7. The apparatus of claim 6 wherein at least one side fluid inlet bore is lower than at least one other side fluid inlet bore.

8. A method of injecting fluid into a wellbore comprising:

providing at the wellhead a fluid injection device having a main housing with a main central bore extending longitudinally therethrough and being aligned with the longitudinal axis of said wellbore, said main central bore having a diameter at least equal to the inside diameter of said wellbore, thereby allowing wellbore equipment full access to said wellbore;

providing at least one fluid inlet bore extending tangentially into said main central bore at an inclined angle to the longitudinal axis of said wellbore, whereby fluid injected into said wellbore from said side fluid inlet bore will travel in a downwardly spiral flow pattern; and directing fluid injected from said side fluid inlet bore to enter said main central bore and travel in a downward spiral flow pattern thereby reducing impingement of said injected fluid upon any device positioned in said wellbore.

9. The method of claim 8 comprising at least two fluid inlet bores wherein at least one side fluid inlet bore is lower than at least one other side fluid inlet bore and injected devices are introduced into the wellbore through said lower side fluid inlet bore due to the force of said fluid being injected through said upper side fluid inlet bore.

10. The method of claim 9 further comprising equipment encumbering said wellbore wherein the height of the entry points of said at least one side fluid inlet bore is chosen to reduce impingement of erosive injection material on said equipment encumbering the well.

11. The method of claim 8 further comprising inserting wellbore equipment encumbering said wellbore before fluid treatment of said wellbore.

12. The method of claim 8 further comprising inserting wellbore equipment encumbering said wellbore during fluid treatment of said wellbore.

13. The method of claim 8 wherein wellbore equipment is encumbering said wellbore further comprising removing said wellbore equipment encumbering the well during fluid treatment of said wellbore.

14. The method of claim 8 wherein wellbore equipment is encumbering said wellbore during fluid treatment of said wellbore further comprising removing said wellbore equipment after fluid treatment of said wellbore.

15. The method of claim 8 wherein the internal diameter, quantity, orientation and downward angles of at least one side fluid inlet bore is chosen to obtain a favorable downward spiral flow pattern.

16. The method of claim 8 wherein the internal diameter, quanitity, orientation and downward angles of at least one side fluid inlet bore is chosen to obtain a favorable horizontal velocity.

17. The method of claim 8 further comprising equipment encumbering said wellbore wherein the internal diameter, quantity, orientation and downward angles of at least one side fluid inlet bore is chosen to reduce impingement of erosive injection material on said equipment encumbering said wellbore.

* * * * *